United States Patent [19]

Elliott

[11] 4,171,472

[45] Oct. 16, 1979

[54] GEARED LIMIT SWITCH

[76] Inventor: Lynn T. Elliott, 60 Bendwood, Sugar Land, Tex. 77478

[21] Appl. No.: 898,677

[22] Filed: Apr. 21, 1978

[51] Int. Cl.[2] ..... H01H 3/16

[52] U.S. Cl. ..... 200/47; 251/67

[58] Field of Search ..... 200/47, 329, 330, 336; 318/266, 468, 467; 251/67, 134, 24; 116/125

[56] References Cited

U.S. PATENT DOCUMENTS

| | | | |
|---|---|---|---|
| 2,571,818 | 10/1951 | Blodgett | 200/47 |
| 3,303,299 | 2/1967 | Raymond, Jr. | 200/47 |

*Primary Examiner*—Willis Little

*Attorney, Agent, or Firm*—John A. Hamilton

[57] ABSTRACT

A limit switch consisting of a driven member connected to a rotary driver member the operation of which is controlled by the limit switch, so as to turn therewith, one or more poles geared to the driven member so as to be rotated thereby, one or more fingers extending laterally from each of the poles, and one or more electric switches mounted adjacent each pole so as to be engaged and operated by one of the fingers at one position in the angular movement of the pole. The gear connection between the driven member and the poles is disengageable by manual means and readily adjustable to provide a coarse setting of the relative angular positions of the driver and poles, and the extension of the fingers from the poles is continuously adjustable to provide a fine setting. The ratio of the gears is such that the poles turn faster than the driver. This multiplies the motion of the fingers and hence provides greater accuracy in the operation of the switches.

6 Claims, 4 Drawing Figures

GEARED LIMIT SWITCH

Figure 1:
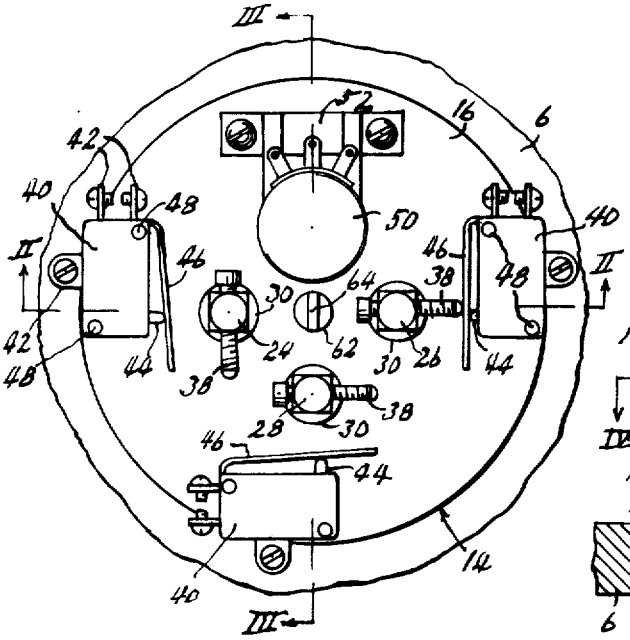

This invention relates to new and useful improvements in limit switches. It has been conceived primarily for controlling the operation of valves driven by power operators, particularly valves of a type which are opened or closed by rotatary movement of their stems through 90 degrees, such as plug valves. The present device will be described in connection with such a valve, although it will be readily apparent that its use is not limited to this application.

An important object of the present invention is the provision of a limit switch providing a high degree of accuracy in its control functions, such as the starting and stopping of an electric motor which operates a valve, to the end that the valve plug will come to rest, in either its closed position or its open position, in extremely close relation to a desired design setting. Generally, this is accomplished by placing a geared connection between the switch driver and the poles carrying the actual switch-operating members, the gears being so proportioned that the poles turn through a multiplied angle as compared to the driver.

Another object is the provision of a limit switch of the character described having both coarse and fine adjustments determining the point in the rotation of the driver at which any switch will be operated. The coarse adjustment may be obtained by manually disconnecting the gears driving each pole, and turning said pole relative to the driver. Since gears have teeth, this movement provides adjustment only in finite steps. The fine adjustment is provided by forming the switch-operating fingers projecting from the poles as screws threaded in the poles, so that the extension thereof may be infinitely varied, the degree of extension determining the point of operation of the associated switch.

A further object is the provision of a limit switch of the character described which is also operable to control other equipment in the flow system of the valve being directly controlled, and which require control or operation in some pattern synchronized with the operation of the directly-controlled valve. Such additional equipment could, for example, include indicating lights or other signals, a remote indicator showing the degree of opening or closing of the valve, pumps, compressors, or other valves. This may be accomplished by providing additional switches to be operated by each pole, or by providing additional poles.

A still further object is the provision of a limit switch of the character described which can be set very simply by hand or by the use of very simple tools, which does not require operation of the valve itself for accurate setting, and the operation and relationship of which to the valve is so readily apparent that it may be set by nearly anyone, not requiring an "expert".

Other objects are simplicity and economy of construction, and efficiency, dependability, ease and convenience of operation.

Figure 2:
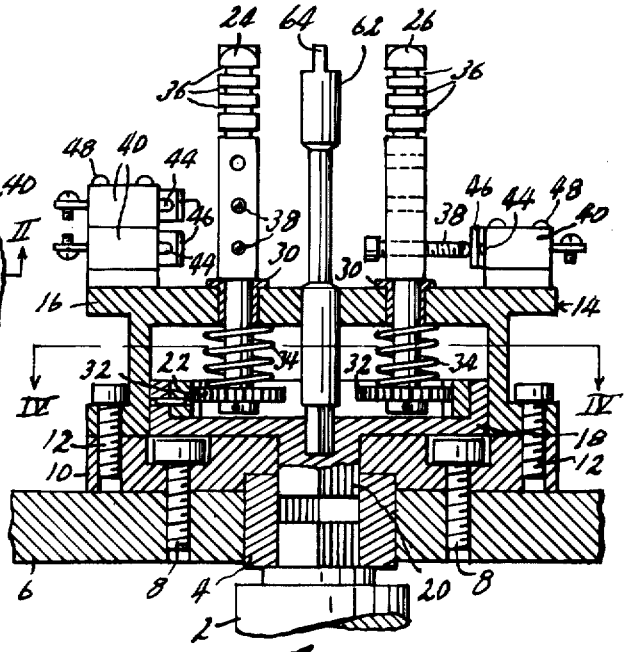
Figure 3:
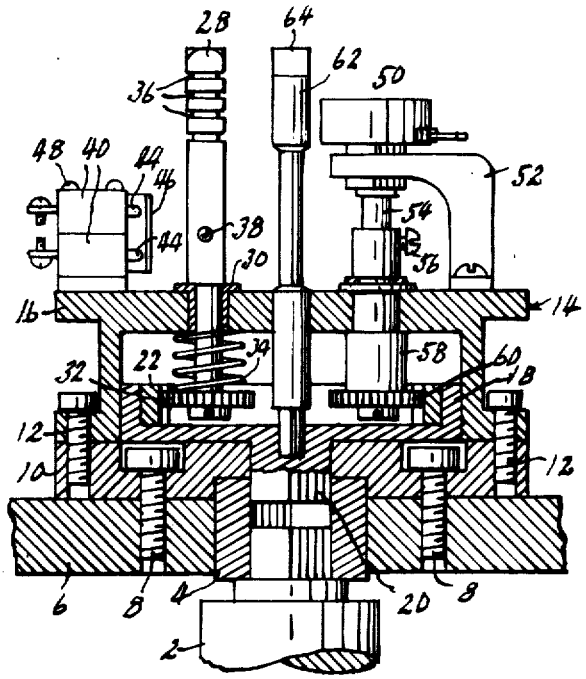
Figure 4:
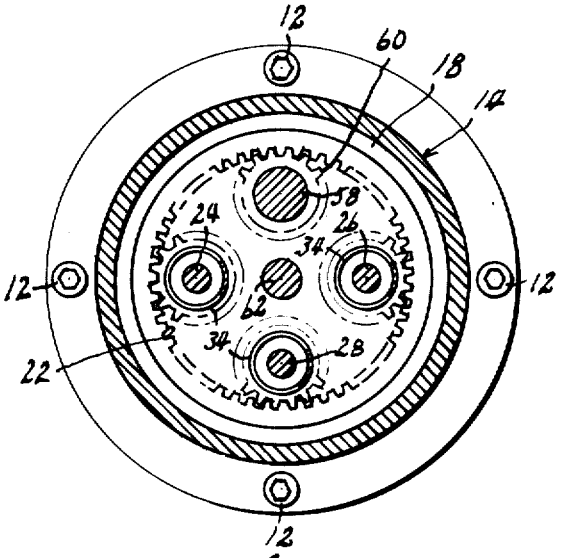

With these objects in view, as well as other objects which will appear in the course of the specification, reference will be had to the accompanying drawing, wherein:

FIG. 1 is a top plan view of a geared limit switch embodying the present invention, FIG. 2 is a sectional view taken on line II—II of FIG. 1, with parts left in elevation, FIG. 3 is a sectional view taken on line III—III of FIG. 1, with parts left in elevation, and FIG. 4 is a sectional view taken on line IV—IV of FIG. 2.

Like reference numerals apply to similar parts throughout the several views, and in FIGS. 2 and 3, the numeral 2 applies to a rotatable driver member, which may be the stem of a valve, not shown, or a member connected to and rotatable with the valve stem. It will be understood that the valve is of a type which may be opened or closed by turning the stem 90 degrees, and that the valve is operated by a valve operator powered by an electric motor, or by means other than an electric motor, such as hydraulic or pneumatic, so long as said power means may be controlled by electric means. The electric motor, or electric control means, are under the control of the limit switch to be described.

Driver 2 has an end thereof engaged non-rotatably in a bearing bushing 4, said bushing in turn being rotatably journalled in a fixed element 6, which may be a portion of the valve body, or an element affixed to the valve body. Affixed to the top of fixed element 6, as by screws 8, is a circular base plate 10. Bearing bushing 4 extends upwardly into a socket formed therefor in the base plate, and is piloted therein. Affixed to the top of said base plate, as by screws 12, is a circular switch housing indicated generally by the numeral 14. Said housing is cylindrical in coaxial relation to driver 2, is open at its lower end where it is affixed to base plate 10, and has a top wall 16 normal to its axis, which serves as a mounting for the switches and switch-operating poles to be described.

A gear carrier 18 having the form of an upwardly opening cup is disposed rotatably in the lower cylindrical portion of housing 14, being of such diameter as to engage rotably therein. It rests in rotatable engagement with the top surface of base plate 10, and has a depending hub 20 which extends rotatably through an aperture formed therefor in the base plate, and is squared for non-rotatable engagement in the top portion of bushing 4, which thus functions as a coupling. Fixed in carrier 18 is an internal ring gear 22 lying in a plane normal to the axis of driver 2 and concentric therewith.

Mounted rotatably in top wall 16 of housing 14 are three elongated poles 24, 26 and 28, which are parallel to the axis of driver 2 and spaced eccentrically apart therefrom, extending both above wall 16, and below said wall into the interior of housing 14. The lower portion of each pole is cylindrically reduced in diameter for rotatable engagement in a bushing 30 fixed in wall 16, and has a pinion gear 32 affixed to the lower end thereof within housing 14. Said pinion gear is normally meshed with internal gear 22, being biased downwardly by a compression spring 34 disposed between the gear and top wall 16 for this purpose, but may be disengaged from the internal gear by grasping and lifting the portion of the pole extending above housing top wall 16, against the bias of its spring 34. The upwardly extending portion of each pole is squared, and has grooves 36 formed therein, in order to form a finger grip which may conveniently be grasped and pulled. Threaded transversely in the upwardly extending portion of each pole are one or more screws 38, the lateral extension of each of which from its associated pole may be accurately adjusted by turning it about its axis, as by means of an Allen wrench or the like.

Mounted on housing top wall 16, in operative relation to each of the poles, are one or more electric switches 40. Each of said switches is of a snap-action type known commonly as a micro-switch. Each switch may have any desired number of internal contacts, either normally-open or normally-closed, and is provided with appropriate external terminals 42 for the attachment of circuit wires thereto. Each switch is operated by depression of an operating button 44 thereof. The case of each switch has a spring-arm 46 attached at one end thereto, the free end portion of said spring arm overlying the operating button of that switch, and extending generally transversely to the associated pole.

A plurality of switches 40 for each pole may be mounted in stacked relation on wall 16, as by screws 48, and as indicated in FIGS. 2 and 3. Generally, a screw 38 is provided in each pole for each of the switches 40 associated with that pole, although as illustrated in FIG. 3 in connection with pole 28, a plurality of switches 40 may be provided with a single spring arm 46, operable by a single screw 38 of that pole. This type of operation may be desirable in some circuits. As driver 2 turns, it operates through internal-gear 22 and pinion gears 32 to turn all of poles 24, 26 and 28 simultaneously at a speed relative to that of the driver determined by the gear ratio, and at a point in the turning of each pole, each screw 38 of that pole, said screw constituting a switch-operating finger, will engage the spring arm 46 of the switch or switches 40 associated with that screw. Further rotation of the pole will depress the spring arm to operate push button 44 of that switch. The spring arm acts as a ramp, so that the screw need not be disposed directly over button 44 to operate the switch, but can operate the switch at variable angular intervals prior to the time the screw comes opposite the push button. Thus a plurality of switches associated with any one pole can be operated in any desired and predetermined sequence.

In many pipeline applications of a valve, remote electrical indication of the position of the valve is required, that is, whether it is open, closed, or at any given position between open and closed. This may be accomplished in the present device by means of a potentiometer the circuit of which includes a variable resistor 50 the case of which is mounted on housing wall 16 by a bracket 52, and having a rotary adjusting stem 54 projecting toward wall 16, and adjustably secured by a set screw 56 in a tubular shaft 58, parallel to the poles 24, 26 and 28. Said shaft is journalled rotatably in wall 16, and has a gear 60 affixed to its lower end and meshed with internal gear 22, in the same manner as the poles. The remainder of the potentiometer circuit may be standard, and is not considered intrinsic to the present invention. A spindle 62 parallel to the poles is affixed non-rotatably at its lower end in internal gear carrier 18, so as to turn with driver 2, extends rotatably through an aperture formed centrally therefor in top housing wall 16, projects upwardly from said top wall, and is provided at its upper end with a diametrically disposed tab 64. This tab serves as a visual indication of the valve position. A suitable weather-protective cover, not shown, may be provided if necessary or desired to cover the entire limit switch assembly.

In describing the operation of the device, it may be presumed that driver 2 represents the stem of the valve being controlled, and that said stem turns 90 degrees in respectively opposite directions to open or close the valve. The limit switch assembly is then mounted on fixed member 6, which as described may be a portion of the valve body, as shown and described. Rotation of valve stem 2 by an operating motor will then act through internal gear 22 and pinion gears 32 and 60 to turn poles 24, 26 and 28, and adjusting stem 54 of potentiometer resistor 50. As shown the ratio of internal gear 22 to each of the pinion gears is 3:1 so that the poles and resistor stem turn through three times the angular movement of stem 2. This provides much greater accuracy in the operation of the switches, as will appear. While this gear ratio, causing the switch poles to travel 270 degrees during the 90 degree movement of the valve stem, is not particularly critical, it is necessary that the poles turn less than a full revolution of 360 degrees.

In the setting of the switch, one of the poles, say pole 26, is selected to control functions which must occur when the valve reaches a closed position. Thus FIG. 1 shows the position of the switch elements when the valve is closed, it being understood that valve stem 2, and the switch poles, turn in a clockwise direction to close the valve, and counter-clockwise to open the valve. Pole 26 is then set coarsely by grasping and lifting it against the pressure of its spring 34 to disengage its pinion gear 32 from internal gear 22, and turned about its axis until its screw or screws 38 are in approximately the correct relation to the switch or switches 40 associated with that pole. This setting may be only approximate, due to the angular spacing between the teeth of the gears. A fine adjustment may be obtained by turning the screw or screws 38 of pole 26 to vary their transverse projection from said pole. This causes said screws actually to contact the spring arms 46 of the switches 40 associated with pole 26 at variable angular positions of the pole, thereby causing any operation controlled by the switches to occur at precisely the required angular position of valve stem 2. It also permits a plurality of switches to be operated by pole 26 at slightly different angular positions of the pole. This is quite important since in many operating circuits, it is required that some contacts be made just before others are broken, or vice versa. The step-up gear ratio between internal gear 22 and the pinion gears of course multiplies the angular movement of each pole as compared to that of valve stem 2, and hence also increases the accuracy of setting the position at which switches 40 controlled by pole 26 will be operated. Examples of operations controlled by pole 26 would be stopping the motor or other power unit heretofore operating to close the valve, the actuating of signal lights indicating closure of the valve, and the control of pumps, compressors, other valves, etc. included in the flow system of the directly-controlled valve and the operation of which must be synchronized with that of the directly-controlled valve.

Another pole, say pole 24, is selected to control operations which must occur when the valve reaches an open position, and said pole is set so that its screws 38 are turned approximately 270 degrees from those of pole 26, in a counter-clockwise direction therefrom as shown, the coarse and fine settings of pole 24 and its screws 38 being carried out as in the case of pole 26. Of course, pole 24 operates only the switches 40 associated with that pole. All of screws 38 are of a type having a tight frictional engagement in the poles, in order that their settings will not be accidentally disturbed. Pole 28 and its associated switches 40 may be utilized to control functions which must occur during the opening or closing movements of the directly-controlled valve, and may be set as in the case of poles 24 and 26 to operate its related switches 40 at any desired point in the angular movement of stem 2. Potentiometer resistor 50 may be adjusted to the actual position of the valve by loosening set screw 56 and turning stem 54 of the resistor in tubular shaft 58.

The advantages of the present device are numerous. It provides greater accuracy of setting of its control points than is provided by any comparable device within my knowledge. It permits the control of a large number of operations, all in a pre-determined, highly accurate sequential pattern. Each pole can control a pluarlity of electrical switches, and even the switches controlled by a single pole can be caused to operate in a pre-determined sequence. The coarse setting thereof requires no tools, and fine setting requires only a simple tool such as an Allen wrench. Its setting procedure is so simple and readily apparent that it can be performed by nearly anyone. Features contributing to this ease of setting are the fact that the limit switch is usually mounted directly on the valve, making its relationship thereto readily apparent, that tab 64 of spindle 62 gives a ready visual indication of the open-or-closed position of the valve, and that poles 24, 26 and 28 turn in the same direction as valve stem 2 as the valve is opened or closed, which is of great assistance in making the settings. Also, the structure is relatively quite simple and economical as compared to any prior devices within my knowledge which might be adapted to perform the same functions.

While I have shown and described a specific embodiment of my invention, it will be readily apparent that many minor changes of structure and operation could be made without departing from the spirit of the invention.

What I claim as new and desire to protect Letters Patent is:

1. A limit switch comprising:

a. a driver member operable to turn rotatably through less than one full revolution, b. a switch housing mounted in a fixed position, c. a switch-operating pole mounted for axial rotation in said switch housing, d. a switch-operating finger mounted transversely in said pole and extending laterally therefrom, e. an electric switch mounted on said housing and having an operating member engageable by said finger to actuate said switch at a predetermined angular position in the rotation of said pole, and f. a driving connection between said driver member and said pole, whereby rotation of the former also causes rotation of the latter said driving connection having a step-up drive ratio such that said pole is caused to turn through a greater arc than said driver member, but still less than a complete revolution, whereby to increase the accuracy with which said switch can be caused to operate at a given angular position of said driver member, wherein said driving connection to said pole includes means whereby said driving connection may be manually disengaged, whereby said pole may be turned manually, and the driving connection again engaged, so as to provide easy angular setting of the finger relative to the switch associated therewith.

2. A limit switch as recited in claim 1 including a plurality of said fingers carried by said pole in longitudinally spaced relation therealong, and a plurality of said switches each operable by one of said fingers, and wherein each of said switches comprises a casing having an operating button projecting therefrom, said switch being operable by depression of said button, and a spring arm affixed at one end to said casing and extending generally normally to the pole in spaced relation therefrom to overlie said operating button, and with the addition of manually operable means for adjusting the lateral extension of the associated pole finger from the pole, whereby each of said fingers may be caused to engage the associated spring arm, and act thereagainst to actuate the associated switch, at variable angular intervals prior to the time said finger moves into registry with said operating button, whereby to adjust independently the angular position of said driver at which actuation of each of said switches will occur.

3. A limit switch as recited in claim 2 wherein said driving connection to said pole constitutes a pair of intermeshing gears carried respectively by said driver member and said pole, whereby disengagement of said gears, manual rotation of said pole, and re-engagement of said gears, provides a stepped, coarse adjustment of the position of the driver at which actuation of each of the switches will occur, and wherein each of said pole fingers constitutes a screw threaded in the pole and projecting laterally therefrom, whereby to provide an infinitely variable projection of said screw to provide a fine adjustment of the angular position of the pole at which actuation of the switch associated with that finger will occur.

4. A limit switch as recited in claim 1 wherein said driving connection between said driver member and said pole comprises.

a. a larger drive gear mounted rotatably in said housing concentrically with said driver member, b. a coupling interconnecting said drive gear to said drive gear to said driver member whereby to turn concurrently therewith, said pole being rotatably mounted in said housing in parallel but, eccentric relation to said drive gear, c. a smaller pinion gear affixed to said pole and meshed with said drive gear, whereby said pole is turned at a greater angular rate than said drive gear, said pole also being longitudinally slidable relative to said housing whereby to disengage its pinion gear from said drive gear, said pole projecting exteriorly of said housing to provide a finger grip whereby said disengagement may be accomplished manually, and d. resilient means biasing said pole in a direction to engage its pinion gear with said drive gear.

5. A limit switch as recited in claim 4 wherein said drive gear constitutes an internal ring gear and said pinion gear constitutes a planetary gear, whereby said pole is caused to rotate in the same direction as said driver member, as an aid in visualizing the operation thereof to assist in the manual setting thereof.

6. A limit switch as recited in claim 5 wherein said switch and said pole finger, as well as the finger grip portion of said pole, are disposed in readily accessible positions exterior to said housing, so as further to facilitate manual setting thereof.

* * * * *